US006347657B1

(12) United States Patent
Bright

(10) Patent No.: US 6,347,657 B1
(45) Date of Patent: Feb. 19, 2002

(54) LIGHTWEIGHT VACUUM DRUM

(75) Inventor: Lyn E. Bright, Ceres, CA (US)

(73) Assignee: B & H Manufacturing Company, Inc., Ceres, CA (US)

( * ) Notice: Subject to any disclaimer, the term of this patent is extended or adjusted under 35 U.S.C. 154(b) by 0 days.

(21) Appl. No.: 09/391,855

(22) Filed: Sep. 8, 1999

(51) Int. Cl.[7] ..... B65C 9/12; B65C 9/14

(52) U.S. Cl. ..... 156/556; 156/567; 156/571; 156/DIG. 30; 156/DIG. 31; 271/276

(58) Field of Search ..... 156/308.6, 449, 156/450, 456, 520, 521, DIG. 26, DIG. 31, 567, 556, 566, 568, 569, 570, 571; 271/276, 275, 196, 314

(56) References Cited

U.S. PATENT DOCUMENTS 4,448,629 A * 5/1984 Malthouse et al. ..... 156/510
4,526,645 A 7/1985 Malthouse et al. ..... 156/350
5,344,519 A * 9/1994 Galchefski et al. ..... 156/456
5,486,253 A 1/1996 Otruba ..... 156/215
5,749,990 A * 5/1998 Rello et al. ..... 156/187

* cited by examiner

*Primary Examiner*—Richard Crispino
*Assistant Examiner*—Sue A. Purvis
(74) *Attorney, Agent, or Firm*—LaRiviere, Grubman & Payne, LLP

(57) ABSTRACT

A lightweight vacuum drum for use in labeling and similar applications having components constructed of castable, non-metal materials. The vacuum drum includes a main drum core having a flexible cylindrical wall casting, investment casting or extrusion of polymeric material coupled to a polymeric bottom ring. A support flange is formed from either aluminum or a polymeric material and is fastened to the cylindrical wall and bottom ring castings. The cylindrical wall includes air passages in fluid communication with radially extending vacuum ports formed in the outer surface of the side wall to provide a vacuum conduit to the outer surface of the cylindrical wall.

24 Claims, 6 Drawing Sheets

LIGHTWEIGHT VACUUM DRUM

TECHNICAL FIELD

The present invention generally relates to vacuum drums, and more specifically to an improved lightweight vacuum drum for use in labeling machines and similar work piece processing equipment.

BACKGROUND ART

Generally, labeling machines operate as a means to transport, prepare and apply labels to containers or other work pieces. Labeling machines typically consist of several components including a rotating vacuum drum as a mechanism for picking-up a web of labels, which may be perforated or, alternatively, a label from a cutting wheel or a stack of precut labels, transporting and positioning the label for subsequent application to a container or work piece. Conventional vacuum drums typically incorporate a set of air passages bored in the generally cylindrical side wall thereof to draw labels onto the surface of the side wall in response to negative air pressure therein. The labels are held on the surface by the resulting vacuum while an adhesive is applied or activated, transported to the correct position and orientation with respect to the surface of the workpiece and applied to the work piece by mechanical engagement and reversal of the air flow through the air passages to discharge the discharge the label from the drum surface. An example of a vacuum drum capable of multiple levels of vacuum is taught in U.S. Pat. No. 5,486,253, which is incorporated by reference as if fully set forth herein and which is owned by the assignee hereof.

Labeling speed and efficiency are important considerations in high volume production canning and bottling plants. The maximum speed and performance capabilities of the vacuum drum in labeling systems may be the most significant component in the design of such systems. The higher the speed, the more precise the tolerance needed for balance and control. In addition, a vacuum drum must be very durable in order to endure in the hostile operating environment in which it will likely be operated. In order to satisfy these requirements, conventional vacuum drums have been formed from all-metal components, such as steel, aluminum, titanium, or other alloys. As a result, known vacuum drum arrangements tend to be very heavy, making them difficult to handle during fabrication, assembly, and repair. In fact, some manufacturers construct the drum so as to be disassembled in segments to facilitate handling.

In addition, the machining process used to fabricate the vacuum drum, particularly forming the air passages in the cylindrical surface, requires expensive machine tools. However, other processes are also used. In addition to materials expense, the overall machining process required for steel, aluminum, titanium, and alloy vacuum drums is very time consuming and labor intensive.

As a result, a need exists for an easily machinable, lightweight vacuum drum which does not otherwise sacrifice optimal performance and durability characteristics.

DISCLOSURE OF INVENTION

The present invention provides a lightweight vacuum drum for picking-up, holding, transporting and positioning label segments for application to a work piece. In a labeling machine utilizing the present invention, the main drum comprises a cylindrical drum, core a support flange affixed to the bottom of the core and a top ring affixed to the top of the core. The core is formed from a polymeric casting, investment casting, or extrusion.

The main drum core includes a generally cylindrical wall having a plurality of vacuum ports formed therein, and a first set of air passages positioned to be in fluid communication with the plurality of vacuum ports. The support flange is fastened to the bottom end of the main drum core cylinder, and includes a second set of air passages formed therein and aligned to overlap the first set of air passages in the cylindrical wall of the main drum core. The second set of air passages are arranged to provide a continuous path for withdrawing air therefrom to form a vacuum thereat. Forming the main drum core from a polymeric material allows more flexibility in design, placement, and orientation of the ports over conventional metal drums. A hub connector is fastened to the support flange for coupling the vacuum drum to a drive shaft located in the labeling machine.

In accordance with one embodiment of the present invention, the main drum core is formed from a nylon based cylindrical wall casting or investment casting coupled to a nylon based bottom ring casting. The support flange and hub connector are formed from either aluminum or a nylon based material. The vacuum drum is connected to an external air pump which draws a vacuum within the drum so that the ports operate to pick-up and hold a label to the outer surface of the drum. Alternatively, the pump produces positive air pressure through the ports to discharge the label from the outer surface to assist in placement of the label on a container or work piece. The vacuum ports can be coupled to an external vacuum control which can vary vacuum or air pressure to meet a desired purpose or application.

In accordance with the present invention, the cylindrical walls of the drum core are flexible. The amount of flexure can be controlled by the composition and malleability of the polymeric material used, the positive and negative air pressure invoked, and by mechanical means to apply force to the rotating cylindrical wall.

These and other advantages of the present invention will become apparent to one of ordinary skill in the air in light of the following description and attached drawings.

BRIEF DESCRIPTION OF DRAWINGS

For fuller understanding of the present invention, reference is made to the accompanying drawing in the following detailed description of the Best Mode of Carrying Out the Present Invention. In the drawing.

Figure 1:
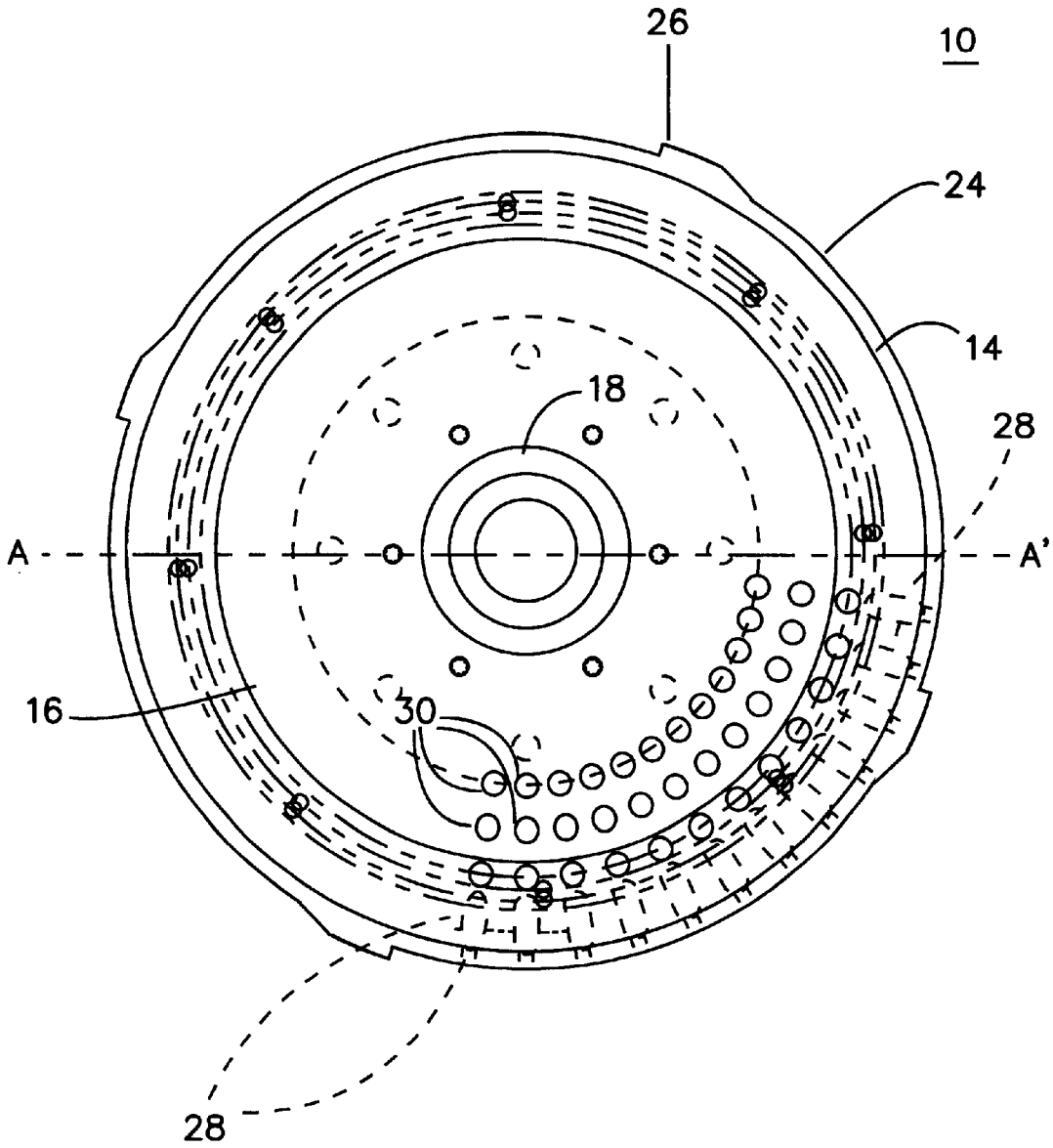
FIG. 1 is a top view of a lightweight vacuum drum in accordance with the present invention.

Reference numbers refer to the same or equivalent parts of the present invention throughout the several figures of the drawing.

BEST MODE FOR CARRYING OUT THE INVENTION

Figure 2:
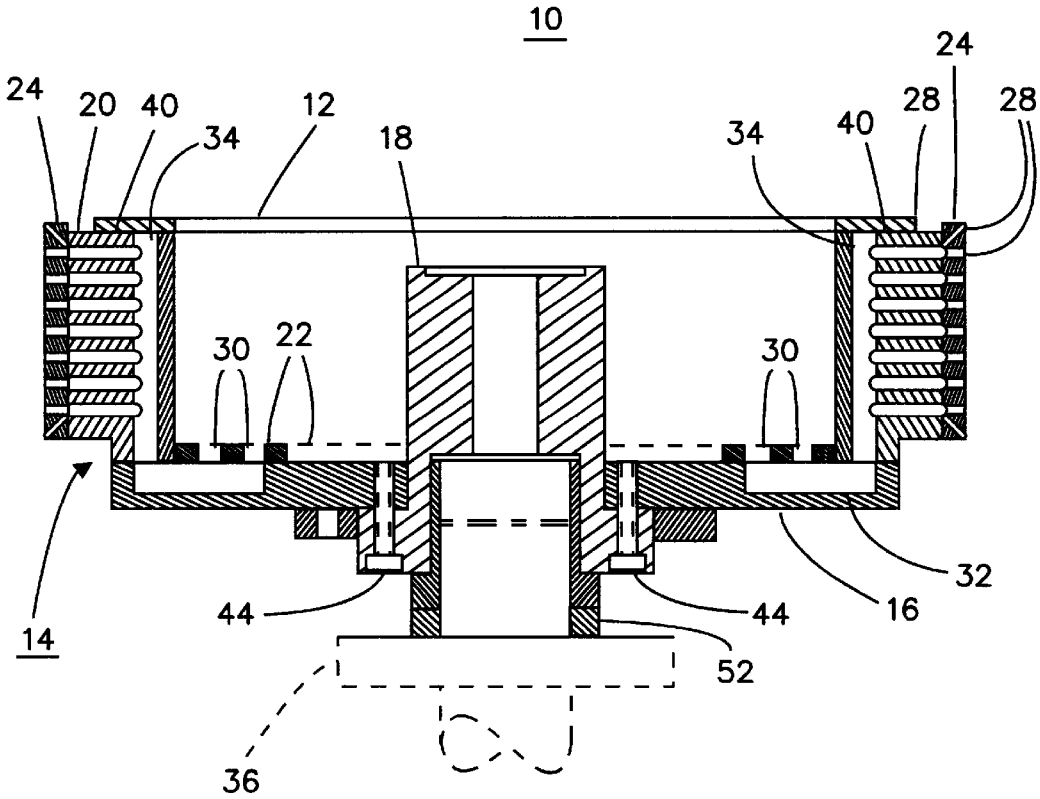
FIG. 2 is a cross-sectional view taken at A–A' of the vacuum drum of FIG. 1.

Referring now to FIGS. 1 and 2, a lightweight vacuum drum 10 for use in a labeling machine is shown in accordance with one embodiment of the present invention. As discussed in more detail below, vacuum drum 10 comprises top ring 12, main drum core 14, bottom support flange 16, and support flange hub assembly 18. It is noted that FIG. 1 illustrates a top view of the vacuum drum assembly without top ring 12. Except as otherwise noted, each part is dimensioned or configured in accordance with known design principles, having an associated function that is understood by one of ordinary skill in the art.

The present invention provides substantial reduction in overall vacuum drum weight relative to conventional steel designs by forming main drum core 14 from a polymeric material capable of casting, investment casting, or extrusion into the desired configuration. One such polymeric material exhibiting sufficient strength for use in the vacuum drum of the present invention is Nycst, which is a species of nylon. Alternatively, a cotton-phenol composite material, or Micarta grades plastic, manufactured by International Paper of Hampton, S.C., having product designations 51F33 and 262, may also be suitable materials. Other polymeric materials exhibiting sufficient coefficient of friction and durability qualities can be used, including materials that moldable and initially malleable enough to take on other forms such as the vacuum drum.

Further in accordance with the present invention, additional weight savings are provided by forming top ring 12, support flange 16 and hub assembly 18 components from either castings, investment castings or extrusions of the same polymeric material as the main drum core, or of aluminum, or a combination of the two to achieve a desired balance between weight and overall assembly strength. One advantage achieved by the weight reduction of the present invention when compared to conventional all-metal vacuum drums is that the number of allowable vacuum holes or ports 28 can be increased without compromising structural integrity. In addition, the holes can be spaced closer together. The ability to provide a greater number of holes and closer spacing improves vacuum drum performance and flexibility of use.

The use of a polymeric material allows the ports to be integrally molded or formed at the time the drum core is constructed. This provides significant design flexibility in the orientation of the ports that cannot be achieved with conventional, all metal drums because of the tooling limitations involved with drilling and machining metal drums. For example, the outer surface of the vacuum drum experiences a tremendous amount of externally applied force during operation due to constant/repetitive contact with a cutter, glue applicator and container. More specifically, for each time a label is applied to a container in a leading and trailing edge labeling process, the drum can be bumped or slapped twice by a label cutter and glue wheel, and once by a container itself. However, the present invention allows the angle of the ports to be oriented to provide a cushioning mechanism to relieve some of the force experienced by the drum by softening initial impact with the container. This is particularly advantageous with glass containers, or PET type containers that have been filled prior to labeling.

Referring to FIG. 2, main drum core 14 includes a combination of a polymeric cylindrical side wall 20 mounted with bottom ring 22 formed from the same material. A rubber or plastic outer vacuum drum pad 24 can be secured to the outer surface of side wall 20. Pad 24 can includes protrusions 26 formed therein at appropriate positions to displace the edges of a label segment from the surface of pad 24 for leading and trailing edge labeling applications. Alternatively, side wall 20 can be molded such that the outer surface thereof includes protrusions 26 integrally formed therein. Pad 24 or the outer surface of side wall 20 may also be contoured to nest with a particular shape of container or other work piece thereby, a drum core 14 rotates for some application foregoing drum pad 24. In addition, side wall 20 alone or taken in combination with pad 24 is flexible and may be designed to instantaneously conform generally to the contours of the work pieces at the port of engagement therewith during operation. Radially extending vacuum ports 28 are formed in the outer surface of cylindrical side wall 20 which align with corresponding ports formed in pad 24. Ports 28 can be angled to optimize performance depending on the application of the vacuum drum. See for example, U.S. Pat. Nos. 5,137,596 and 5,271,783 assigned to the assignee hereof and incorporated by reference as if fully set forth herein.

At least one vacuum fitting (not shown) can be attached to a stationary valve plate (also not shown) mounted within cylindrical side wall 20 about hub assembly 18 so as to be in fluid communication with bottom ring 22. The stationary valve plate provides a stationary member to which the vacuum fitting(s) can be connected. Vacuum is supplied to vacuum drum 10 through the vacuum fitting(s), and is channeled via air passage openings 30 formed in bottom ring 22. Vacuum provided to the stationary valve plate is first coupled through openings 30 to overlapping conduit 32 formed in support flange 16, and then to passageways 34 formed in side wall 20 orthogonally overlapping and aligned with vacuum ports 28 to be in fluid communication therewith. Drum core 14 and support flange 16 rotate relative to the stationary valve plate to control the timing and volume of vacuum air withdrawn to form a vacuum at vacuum ports 28 via openings 30 and conduit 32. An external vacuum control (not shown) can be provided to control vacuum flow and strength to suit the intended application of the drum. The present invention can utilize a vacuum source that creates variable volume/pressure gradients, from high volume/low pressure within the ports, to low volume/high pressure within the ports.

Drive shaft 36 is coupled to a motor (not shown), such as an AC, or a DC or a stepper motor, to provide rotation of the vacuum drum assembly. Hub assembly 18 connects the vacuum drum assembly to the shaft and provides support for the vacuum drum as it rotates.

Figure 3A:
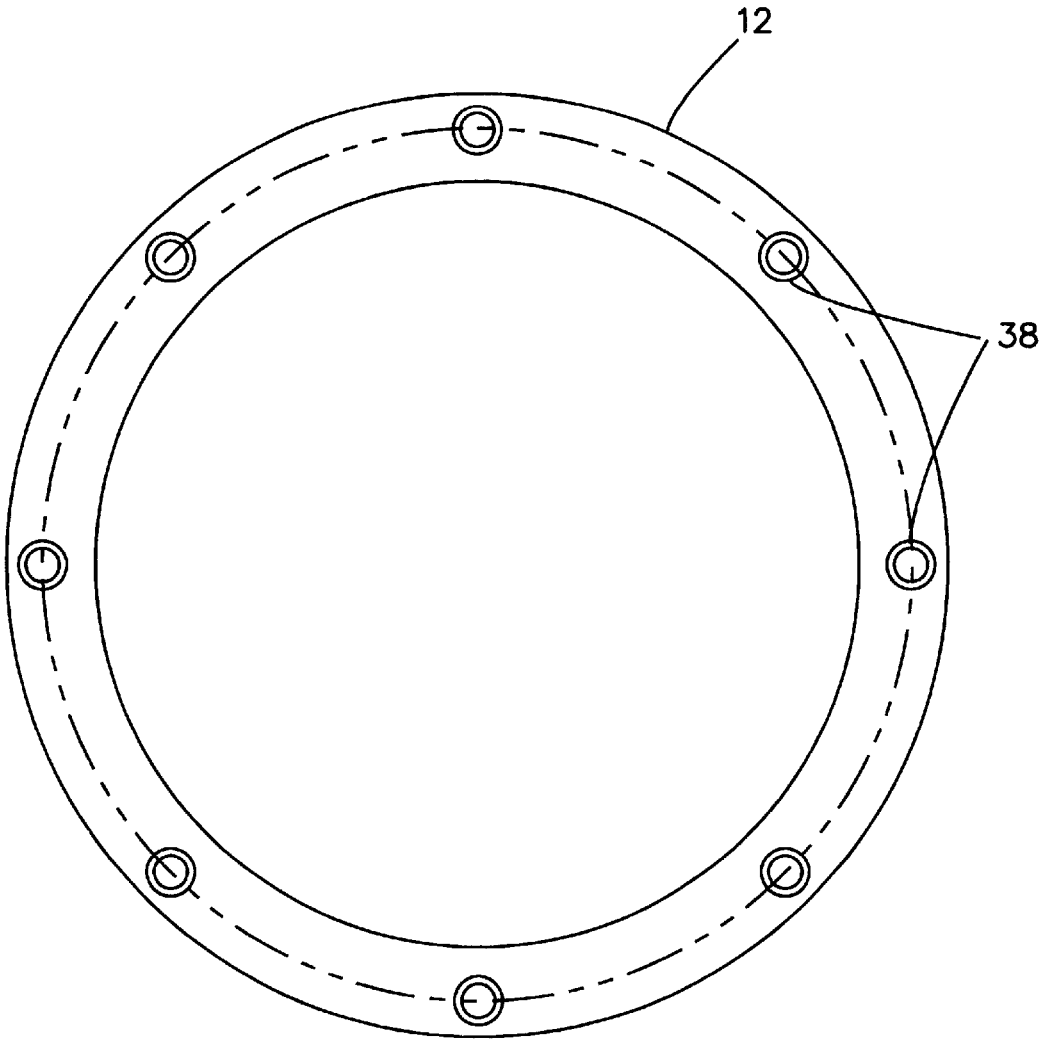
FIGS. 3*a* and *b* are top and side views, respectively, of the top ring of the vacuum drum of FIG. 1.
Figure 3B:
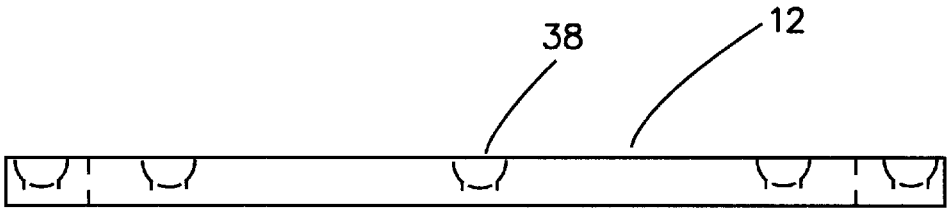

FIGS. 3*a* and 3*b* show top ring 12 of drum 10. As shown, top ring 12 is machined with countersunk holes 38 through which bolts pass for engagement with corresponding threaded holes 40 formed in the top surface of cylindrical side wall 20. As noted previously, top ring 12 can be stamped from aluminum, or cast, investment cast, or extruded from the selected polymeric (e.g. nylon based) material to reduce weight. Top ring 12 seals passageways 34 in side wall 20 and provides convenient disassembly of the drum for maintenance and servicing.

Figure 4B:
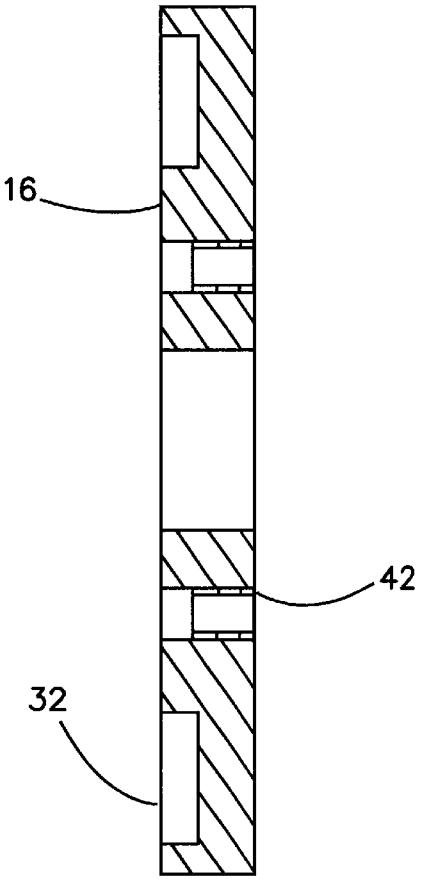
FIGS. 4*a* and *b* are to and cross-sectional views, respectively of the support flange of the vacuum drum of FIG. 1.
Figure 4A:
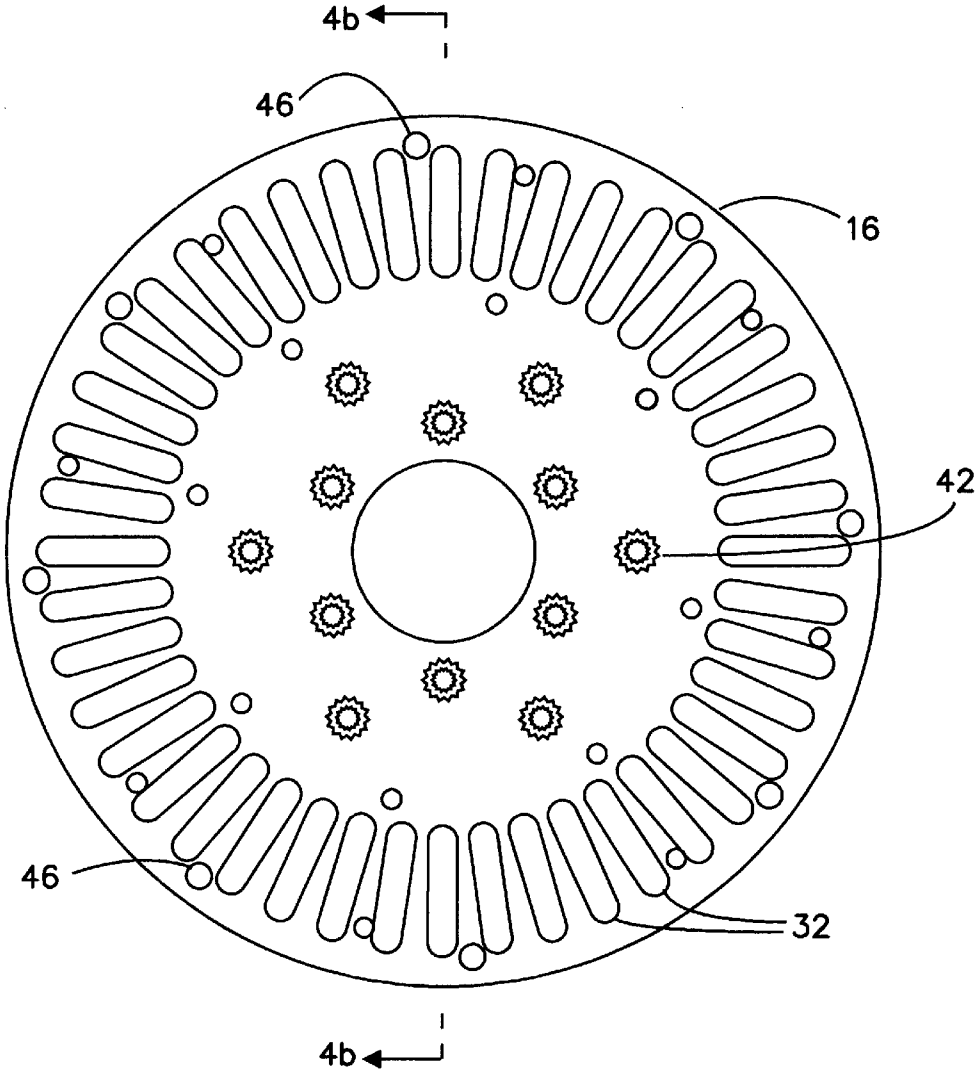

Referring to FIGS. 4*a* and 4*b* support flange 16 includes threaded holes 42 formed therein for securing hub assembly 18 using bolts 44 (as shown in FIG. 2). Holes 46 are formed near the periphery of flange 16 for affixing flange 16 to the bottom side of side wall 20 using threaded fasteners (not shown). As noted previously, support flange 16 can be stamped from aluminum, or cast, investment cast, or extruded from the selected polymeric material, e.g. the afore-mentioned nylon based material, to reduce weight. Conveniently, support flange 16, as well as drum core 14 and top ring 12, may also be color-coded with colored identification plugs or constructed of homogeneously color-coded material for quickly identifying the correspondingly sized work pieces with which the drum of the present invention should be used.

Figure 5A:
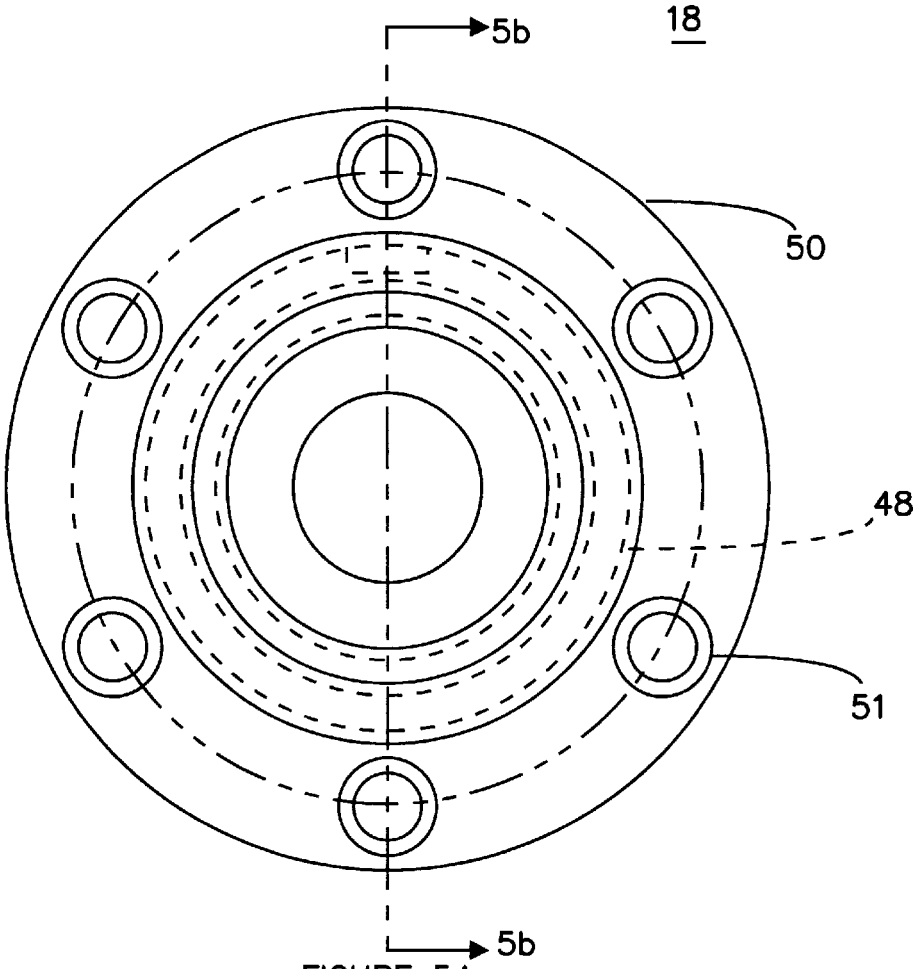
FIGS. 5*a* and *b* are top and cross-sectional views, respectively, of the support flange hub assembly of the vacuum drum of FIG. 1.
Figure 5B:
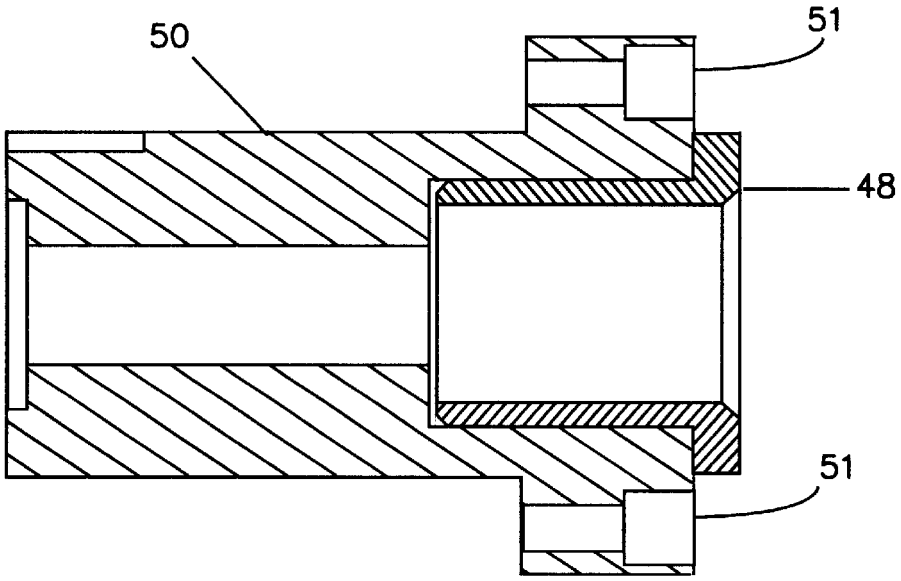

With reference to FIGS. 5*a* and 5*b,* hub assembly 18 includes hub sleeve 48 inserted into hub support flange 50. Hub support flange 50 includes countersunk holes 51 disposed along the periphery thereof to accommodate bolts 44 for fastening the hub assembly to support flange 16. Sleeve 48 is dimensioned to fit about the drive shaft when vacuum drum 10 is mounted thereto. As shown in FIG. 2, sleeve 48 may be used in combination with a spacer 52. As noted previously, hub assembly 18 can be formed from aluminum, polymeric casting, investment casting or extrusion, or a combination thereof. More specifically, hub support flange 50 can be formed from aluminum to optimize strength of the drive shaft coupling, while sleeve 48 can be formed as a nylon casting/investment casting/extrusion.

Figure 6:
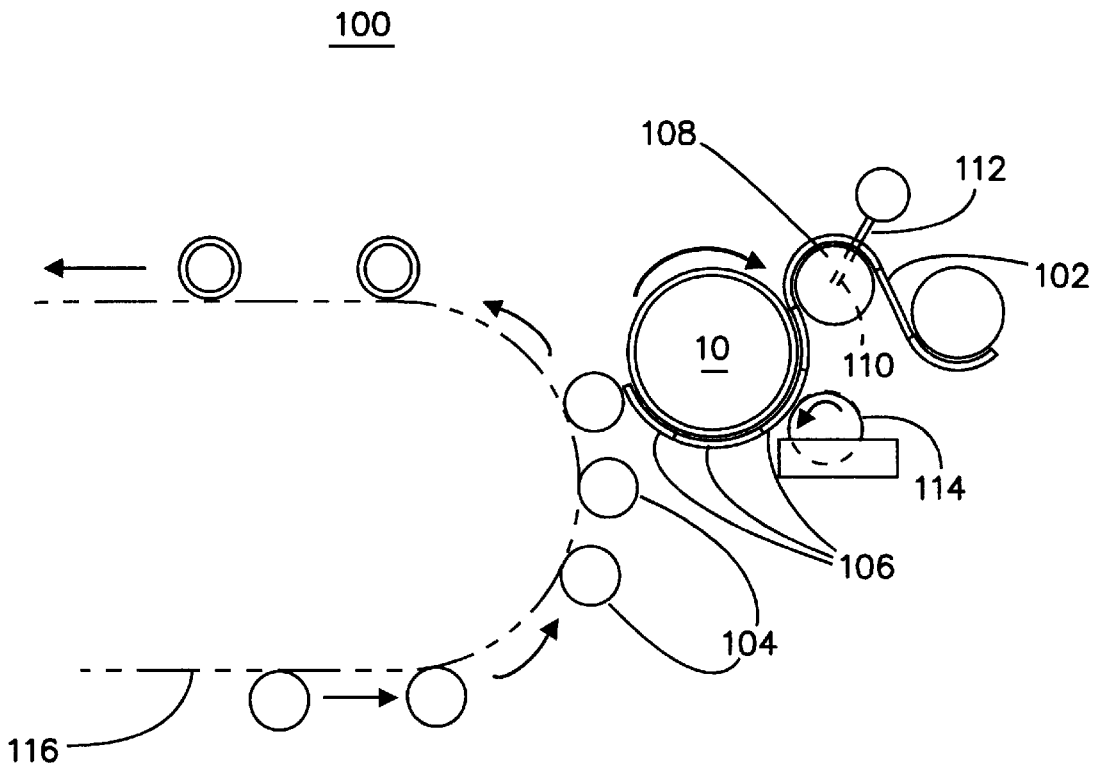
FIG. 6 is a schematic plan view of a labeling machine utilizing the vacuum drum of FIG. 1.

Referring now to FIG. 6, a general schematic of labeling machine 100 is shown as an exemplary arrangement for incorporating vacuum drum 10 in accordance with the present invention. As shown, labeling material web 102 is supplied to labeling machine 100 for application to containers 104. Labeling material web 102 is cut into label segments 106 by cutter drum 108. Cutter drum 108 includes at least one cutter blade 110 which is rotated with the cutter drum 108, and operates in cooperation with a stationary cutter blade 112 through cyclical contact to cut label segments 106 to the desired length. Vacuum drum 10 picks up label segments 106 from the cutter drum 108, and holds, transports and positions each label segment for application to respective containers 104.

As previously described, an external air source (not shown) is connected to the vacuum drum and timed to control the level of vacuum provided at the surface of the drum. For example, the level of vacuum is preferably controlled so that when label segments 106 are transferred from cutter drum 108 to vacuum drum 10, tension on label segments 106 is set to provide optimum cutting action while reducing the likelihood of splitting or otherwise changing label segments 106 and providing better control over movement and orientation of each label segment.

With continuing reference to FIG. 6, treatment apparatus 114 prepares label segments 106 for adhesion to a container or article. Treatment apparatus 114 may be a glue wheel, a glue spring device or a localized heat application source. A localized heat application source is usable with label segments having a previously applied coating of adhesive that is subsequently heat or UV activatable among several well known ways of activating glue for applying labels to work pieces. Heat activatable adhesive may then be activated by a hot air blast or any other mechanism for locally heating the adhesive coated surface of the label. Treatment apparatus 114 treats each label segment while the label segments are held on vacuum drum 10. Label segments 106 are held on vacuum drum 10 until applied to a respective container, such as by urging each container into contact with vacuum drum 10 to allow the label segment to adhere and wrap about the container. Prior to being labeled, containers 104 are held by a staging device (not shown). The staging device may be a star wheel, roller or screw feed. Containers 104 are moved by a conveyor 116 into and out of the labeling station.

In some labeling operations, each label is perforated along all four edges. The perforations enhance registration of each label on the work piece when used in cooperation with the lightweight drum of the present invention. In addition, by timely and controlled reversal of the air flow which forms the vacuum within vacuum drum 10, the labels can be "punched out" of the web at the moment of application to the work piece. See for example, U.S. Pat. No. 5,240,755, assigned to the assignee hereof and which is incorporated by reference as if fully set forth herein.

Therefore, the present invention advantageously provides a vacuum drum for use in a labeling machine which significantly reduces weight without compromising overall durability. The interactive vacuum drum of the present invention uses a selection of different materials that bring together design flexibility as well as the ability to incorporate structural "give" into the side walls of the drum. Thus, the vacuum drum of the present invention is applicable to labeling processes involving a wider range of applications and work pieces.

The lighter weight of the present vacuum drum provides significant advantages over prior all-metal designs by allowing the various drive components to be made of lighter weight materials to produce while still maintaining the same or higher structural integrity and label processing speeds. For example, some labeling machines require the use of an expensive and heavy duty drive belt or chain to rotate the drive shaft. The lightweight vacuum drum of the present invention may allow the use of less expensive and lighter duty drive belts which further reduces shipping costs as well as further facilitating handling and maintenance procedures.

In addition, the lower weight significantly simplifies vacuum drum maintenance which typically requires complete removal of the vacuum drum from the labeling machine for servicing. Prior all-metal, usually steel, drums require heavy equipment to lower and raise the drum from the labeling machine to remove the drum for service.

Still further, the lighter weight allows a larger diameter drum to be used in place of a smaller all-metal drum. This advantageously allows for significantly increased labeling speed by increasing the number of labels and containers that are processed per rotation of the vacuum drum.

The use of a polymeric materials such as a nylon based plastic casting significantly eases the task of forming the various vacuum ports and air passageways in the drum by eliminating or reducing the need for expensive tooling and time consuming metal cutting procedures. The polymeric material of the present invention does not otherwise sacrifice operational potential provided by conventional all-metal drums, because sufficient structural integrity is retained for rugged operation with other mechanical parts such as cutter blades for cutting labels and high-speed repeated contact with work pieces. In fact, a vacuum drum according to the present invention can transport and align labels for application at specific location on a container or work piece, can support external manipulation of vacuum pressure to facilitate particular orientation of a label on a container, and can facilitate many known on-drum label processing techniques such as hot seal, UV seal, cold seal, gamma rays, directed air and the like.

The flexible side walls of the present invention also provide flexibility in accommodating the shape, size, and nature of work pieces to be labeled. The vacuum drum according to the present invention is thus able to accommodate variable size containers during a single labeling operation.

It will be appreciated that the present invention is adaptable to meet a wide variety of different labeling processing requirements. The vacuum drum can be modified as necessary depending on the specific requirements of a particular type of labeling machine, label material or work piece. Thus, while the best mode for carrying out the invention has been described in detail, those familiar with the art to which this invention relates will recognize various alternative designs and embodiments for practicing the invention as defined by the following claims.

The present invention has been particularly shown and described with respect to certain preferred embodiments and features thereof. However, it should be readily apparent to those of ordinary skill in the art that various changes and modifications in form and detail may be made without departing from the spirit and scope of the inventions as set forth in the appended claims. The inventions illustratively disclosed herein may be practiced without any element which is not specifically disclosed herein.

I claim:

1. A vacuum drum, coupled to a reversible, externally-generated vacuum source and to a source of rotational power, said drum comprising:

a drum core having a flexible cylindrical side wall, a plurality of vacuum ports formed in the outer surface of said wall, and first air passages formed in said side wall coupled to said plurality of vacuum ports;

first means, coupled to said drum core, having second air passages formed therein coupled to said first air passages, for coupling to said source of externally generated vacuum; and second means, coupled to said drum core near said first air passages, for coupling to said rotational power source.

2. A vacuum drum comprising:

a main drum core having a flexible, cylindrical side wall, a plurality of vacuum ports formed in the outer surface of said side wall, and a first set of air passages formed in said side wall and in fluid communication with the plurality of vacuum ports;

a support flange fastened to one end of the cylindrical side wall having a second set of air passages formed therein and in fluid communication with the first set of air passages, said second set of air passages arranged to provide a continuous fluid path for coupling to a source of externally generated vacuum;

a top ring fastened to the other end of the main drum core for sealing the ends of the first set of air passages; and a hub connector fastened to the support flange for coupling the vacuum drum to rotational power source.

3. The vacuum drum as in claim 2 further including a pad secured to the outer surface of the main drum core side wall, said pad having vacuum ports formed therein and aligned with vacuum ports in the side wall.

4. The vacuum drum as in claim 3 wherein the pad includes outwardly extending protrusions positioned to displace leading and trailing edges of a label segment from the outer surface of the pad while being held thereon.

5. The vacuum drum as in claim 2 wherein the outer surface of the main drum core side wall includes outwardly extending protrusions positioned to displace leading and trailing edges of a label segment from said outer surface of the vacuum drum while being held thereon.

6. The vacuum drum as in claim 2 wherein the flexibility of the main drum core side wall accommodates different shapes and sizes of a work piece.

7. The vacuum drum as in claim 2 where the main drum core is formed of a polymeric material.

8. The vacuum drum as in claim 2 wherein the support flange is formed of aluminum.

9. The vacuum drum as in claim 2 wherein the support flange is formed of a polymeric material.

10. The vacuum drum as in claim 2 wherein the hub connector is formed of aluminum.

11. The vacuum drum as in claim 2 wherein the hub connector includes a hub flange formed from a polymeric material.

12. The vacuum drum as in claim 2 wherein the support flange is formed from a casting of nylon based material.

13. The vacuum drum of claim 2 wherein the top ring is formed of aluminum.

14. The vacuum drum of claim 2 wherein the top ring is formed from an investment casting of polymeric material.

15. The vacuum drum of claim 2 wherein the main drum core is formed from a casting of polymeric material.

16. The vacuum drum of claim 2 wherein the main drum core is formed from an investment casting of polymeric material.

17. The vacuum drum of claim 2 wherein the main drum core is formed from an extrusion of polymeric material.

18. The vacuum drum of claim 2 wherein the outer surface of the main drum core flexibly conforms to the surface contours of work pieces.

19. The vacuum drum of claim 2 wherein the plurality of vacuum ports are integrally formed with the main drum core, and are oriented with an angle relative to the surface of the main core to cushion contact with a work piece.

20. A workpiece labeling apparatus, coupled to a reversible, externally generated source of vacuum and to a source of rotational power and to a source of label segments, said apparatus comprising:

a flexible cylindrical side wall forming a flexible drum core having a plurality of vacuum ports formed in the outer surface of said wall, and first air passages formed in said side wall coupled to said plurality of vacuum ports;

first means, coupled to said drum core, having second air passages formed therein coupled to said first air passages, for coupling to said source of externally generated vacuum;

second means, coupled to said drum core near said first air passages, for coupling to said rotational power source; and the outer surface of the drum core flexibly conforms to the surface contours of said work piece.

21. The workpiece labeling apparatus of claim 20 wherein the flexibility of the drum core side wall accommodates different shapes and sizes of a work piece.

22. The workpiece labeling apparatus of claim 20 wherein the outer surface of the drum core side wall includes outwardly extending protrusions positioned to displace leading and trailing edges of a label segment from said outer surface of the vacuum drum while being held thereon.

23. The workpiece labeling apparatus of claim 20 wherein the label segments are perforated and are applied to the work piece in response to reversal of vacuum at the moment of application thereto.

24. The workpiece labeling apparatus of claim 20 wherein: said first means is a support flange fastened to one end of the cylindrical side wall said second air passages being in fluid communication with the first air passages, said second air passages being arranged to provide a continuous fluid path for coupling to a source of externally generated vacuum; and said second means is a top ring fastened to the other end of the drum core for sealing the ends of the first air passages and a hub connector fastened to the support flange for coupling the vacuum drum to the rotational power source.

* * * * *